US006363552B1

(12) United States Patent
Hornbach et al.

(10) Patent No.: US 6,363,552 B1
(45) Date of Patent: Apr. 2, 2002

(54) BED SIDERAIL

(75) Inventors: David W. Hornbach, Brookville, IN (US); Robert Mark Zerhusen, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/528,464

(22) Filed: Mar. 17, 2000

(51) Int. Cl.[7] ..... A47C 21/08; A61G 7/05
(52) U.S. Cl. ..... 5/425; 5/616; 5/428; 5/430
(58) Field of Search ..... 5/613, 617, 425, 5/427, 428, 429, 430

(56) References Cited

U.S. PATENT DOCUMENTS

| | | | | |
|---|---|---|---|---|
| 421,656 A | | 2/1890 | Blanken | |
| 993,119 A | | 5/1911 | Stannard | |
| 2,136,088 A | | 11/1938 | Stevens, Sr. | |
| 2,587,291 A | * | 2/1952 | Des Rochers | 5/430 |
| 2,644,173 A | | 7/1953 | James | |
| 2,710,976 A | | 6/1955 | Martensen | |
| 2,722,017 A | | 11/1955 | Burst et al. | |
| 2,817,854 A | | 12/1957 | Pratt | |
| 2,817,855 A | | 12/1957 | Pratt | |
| 2,951,252 A | | 9/1960 | Roche | |
| 3,018,492 A | | 1/1962 | Rosen | |
| 3,021,534 A | | 2/1962 | Hausted | |
| 3,055,020 A | | 9/1962 | Mann | |
| 3,148,387 A | | 9/1964 | Sarnie, Jr. et al. | |
| 3,249,387 A | | 5/1966 | Pivacek | |
| 3,321,779 A | | 5/1967 | Kaufman et al. | |
| 3,344,445 A | | 10/1967 | Crawford | |
| 3,351,962 A | | 11/1967 | Dodrill et al. | |
| 3,486,176 A | | 12/1969 | Murcott | |
| 3,585,659 A | | 6/1971 | Burst et al. | |
| 3,593,350 A | * | 7/1971 | Knight | 5/616 |
| 3,619,824 A | | 11/1971 | Doyle | |
| 3,742,530 A | | 7/1973 | Clark | |
| 3,851,345 A | | 12/1974 | Benoit et al. | |
| 3,865,434 A | | 2/1975 | Sully | |
| 3,877,090 A | | 4/1975 | Schutz | |
| 3,905,591 A | * | 9/1975 | Schorr et al. | 5/425 |
| 3,971,083 A | | 7/1976 | Peterson | |
| 4,183,015 A | | 1/1980 | Drew et al. | |
| 4,186,456 A | * | 2/1980 | Huempfner | 5/430 |
| 4,214,326 A | | 7/1980 | Spann | |
| 4,215,446 A | | 8/1980 | Mahoney | |
| 4,232,415 A | | 11/1980 | Webber | |
| 4,370,765 A | | 2/1983 | Webber | |
| 4,439,880 A | | 4/1984 | Koncelik et al. | |
| D276,112 S | | 10/1984 | Ferrell et al. | |
| 4,607,402 A | | 8/1986 | Pollard | |
| 4,612,679 A | | 9/1986 | Mitchell | |
| 4,653,129 A | | 3/1987 | Kuck et al. | |

(List continued on next page.)

FOREIGN PATENT DOCUMENTS

| | | |
|---|---|---|
| DE | 199 00 602 C1 | 7/2000 |
| EP | 0 037 063 A2 | 10/1981 |
| WO | WO 98/17153 | 4/1998 |

OTHER PUBLICATIONS

Catalog : "A Hill–Rom Solution: Med–Surg Bed Accessories," Hill–Rom, 1997.

*Primary Examiner*—Michael F. Trettel
(74) *Attorney, Agent, or Firm*—Bose McKinney & Evans LLP

(57) ABSTRACT

A bed is provided having a bedframe, a first pair of siderails, and a second pair of siderails. The bedframe includes an articulating deck having first and second sections that move relative to each other. The first pair of the siderails is coupled to the second section of the deck to move therewith. At least one pair of the siderails is configured to move relative to the other pair of siderails to compensate for movement of the first pair of siderails with the second section of the deck.

74 Claims, 6 Drawing Sheets

U.S. PATENT DOCUMENTS 4,654,903 A 4/1987 Chubb et al.
4,670,923 A 6/1987 Gabriel et al.
4,672,698 A 6/1987 Sands
4,676,687 A 6/1987 Koffler
4,704,750 A 11/1987 Wheelock
4,710,049 A 12/1987 Chang
4,710,992 A 12/1987 Falwell et al.
4,745,647 A 5/1988 Goodwin
4,747,171 A 5/1988 Einsele et al.
4,767,419 A 8/1988 Fattore
4,768,249 A 9/1988 Goodwin
4,783,864 A 11/1988 Turner
4,800,600 A 1/1989 Baum
4,827,545 A 5/1989 Arp
4,839,933 A 6/1989 Plewright et al.
4,872,228 A 10/1989 Bishop
4,873,734 A 10/1989 Pollard
4,985,946 A * 1/1991 Foster et al. ..... 5/430
4,993,089 A 2/1991 Solomon et al.
5,010,611 A 4/1991 Mallett
5,035,014 A 7/1991 Blanchard
5,044,025 A 9/1991 Hunsinger et al.
5,077,843 A 1/1992 Dale et al.
5,083,332 A 1/1992 Foster et al.
5,083,334 A 1/1992 Huck et al.
5,084,925 A 2/1992 Cook
5,097,550 A 3/1992 Marra, Jr.
5,129,117 A 7/1992 Celestina et al.
5,175,897 A 1/1993 Marra, Jr.
5,179,774 A 1/1993 Foster et al.
5,191,663 A 3/1993 Holder et al.
D336,577 S 6/1993 Celestina et al.
5,216,768 A 6/1993 Bodine et al.
5,381,571 A 1/1995 Gabbart
5,384,927 A 1/1995 Mardero et al.
5,410,765 A 5/1995 Dicken
5,418,988 A 5/1995 Iura
5,421,046 A 6/1995 Vande Streek
5,450,641 A 9/1995 Montgomery
5,455,973 A 10/1995 Brumfield et al.
5,481,772 A 1/1996 Glynn et al.
5,485,699 A 1/1996 Gabhart
5,524,306 A 6/1996 George
5,537,701 A * 7/1996 Elliott ..... 5/616
5,557,817 A 9/1996 Haddock
5,577,277 A 11/1996 Sundberg et al.
5,642,545 A 7/1997 Howard
5,671,490 A 9/1997 Wu
5,678,267 A 10/1997 Kinder
5,689,839 A 11/1997 Langaniere et al.
5,732,423 A 3/1998 Weismiller et al.
5,749,112 A 5/1998 Metzler
5,761,756 A 6/1998 Nowak et al.
5,771,506 A 6/1998 Joiner
5,781,945 A 7/1998 Scherer et al.
5,802,636 A 9/1998 Corbin et al.
5,832,549 A 11/1998 Le Pallec et al.
5,864,900 A 2/1999 Landau
5,878,452 A 3/1999 Brooke et al.
5,926,873 A 7/1999 Fountain
6,058,531 A 5/2000 Carroll

* cited by examiner

BED SIDERAIL

BACKGROUND AND SUMMARY OF THE INVENTION

The present invention relates to a bed, and particularly to a bed having barriers. More particularly, the present invention relates to a hospital bed or a patient-care bed which includes siderails that move relative to each other.

It is known to provide beds having a support surface which can be manipulated to adjust the position of the person on the support surface. It is also known to provide barriers such as siderails, headboards, and footboards on these beds. When the support surfaces of these beds are manipulated to adjust the position of the person on the support surfaces, the barriers move relative to each other and often a gap between the barriers changes in dimension as the barriers are moved.

According to the present invention, a bed is provided having a bedframe and first and second siderails. The bedframe includes a deck support and a deck coupled to the deck support. The deck includes a first section and a second section configured to move between first and second positions relative to the deck support. The first siderail is coupled to the bedframe and the second siderail is coupled to the second section of the deck. The second siderail is configured to move relative to the second section of the deck to compensate for movement of the second section of the deck relative to the first section of the deck.

According to another embodiment of the present invention, the second siderail is slidably coupled to the second section of the deck. The bed further includes a controller coupled to at least one of the first and second siderails to control relative movement of the first and second siderails to compensate for the relative movement the components of the bedframe.

According to another embodiment of the present invention, a bed is provided that includes a bedframe and a siderail. The siderail is configured to rotate about an axis of rotation between first and second positions. The siderail is positioned from the axis of rotation by a first distance when in the first position and positioned from the axis of rotation by a second distance when in the second position. The second distance is greater than the first.

According to yet another embodiment of the present invention, a bed is provided including a bedframe, a first siderail coupled to the bedframe, and a second siderail. The bedframe includes a deck support and a deck configured to articulate. The second siderail is coupled to the deck and the second siderail is spaced apart from the first siderail by a distance to define a gap therebetween. The bed further includes means for moving at least one of the first siderail relative to the bedframe and the second siderail relative to the deck to maintain the distance between the first and second siderails due to the articulation of the deck. According to yet another embodiment of the present invention, the bed includes means for moving at least one of the first and second siderails to maintain the distance between the first and second siderails to compensate for the movement of the second siderail with the deck.

Additional features of the disclosure will become apparent to those skilled in the art upon consideration of the following detailed description when taken in conjunction with the accompanying drawings.

BRIEF DESCRIPTION OF THE DRAWINGS

The detailed description particularly refers to the accompanying figures in which.

DETAILED DESCRIPTION OF THE INVENTION

Figure 1:
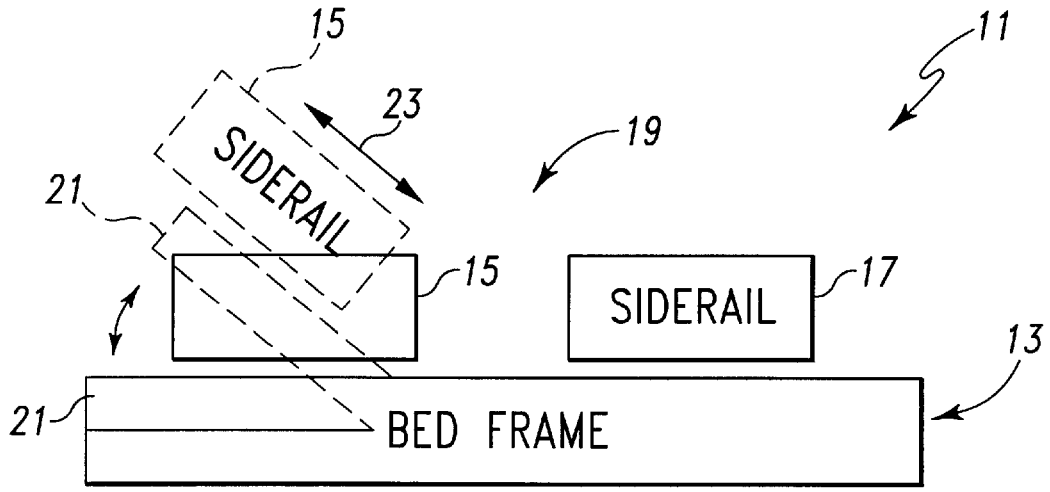
FIG. 1 is a diagrammatic view of a bed showing the bed including a bedframe and a pair of siderails defining a gap therebetween, a portion of the bedframe being moveable between a first position and a second position (in phantom), one of the siderails moving with the portion of the bedframe, and said siderail moving relative to the portion of the bedframe during movement of the portion of the bedframe.

A bed 11 according to the present disclosure is shown diagrammatically in FIG. 1. Bed 11 includes a bedframe 13 and first and second siderails 15, 17. First siderail 15 is movably coupled to bedframe 13 and second siderail 17 is coupled to bedframe 13 to cooperate with first siderail 15 to define a gap 19 therebetween.

A portion 21 of bedframe 13 is moveable between a first position and a second position shown in phantom. First siderail 15 is configured to move with portion 21 of bedframe 13 so that first siderail 15 moves relative to second siderail 17. During or after the initial relative to movement of first and second siderails 15, 17, first siderail 15 moves relative to second siderail 17 in direction 23 to compensate for the initial relative movement. This compensatory movement in direction 23 aids in maintaining gap 19 substantially constant.

Figure 2:
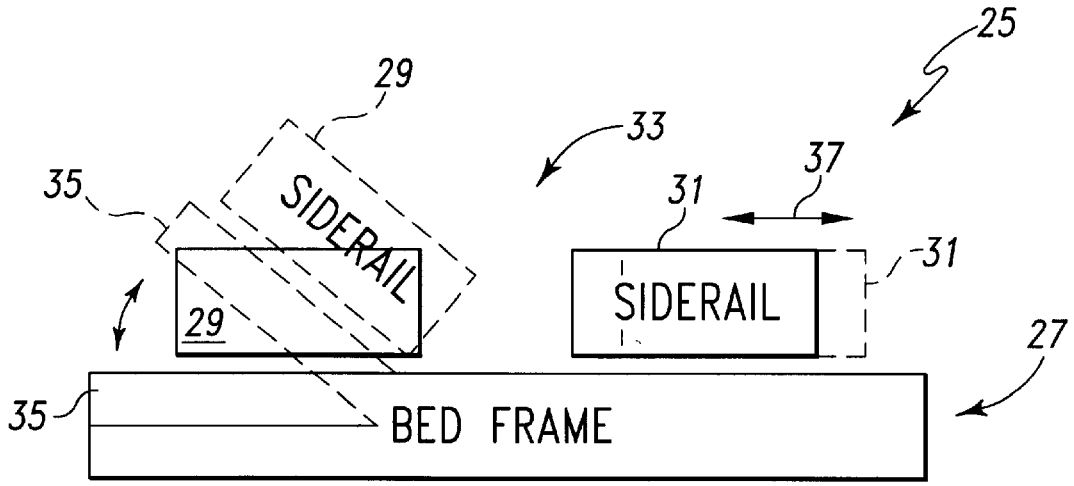
FIG. 2 is a diagrammatic view of another bed showing the bed including a bedframe and a pair of siderails defining a gap therebetween, a portion of the bedframe being moveable between a first position and a second position (in phantom), one of the siderails moving with the portion of the bedframe, and the other siderail moving relative to the bedframe during movement of the portion of the bedframe.

A bed 25 according to another embodiment of the present disclosure is shown diagrammatically in FIG. 2. Bed 25 includes a bedframe 27 and first and second siderails 29, 31. Second siderail 31 is moveably coupled to bedframe 27 and first siderail 29 is coupled to bedframe 13 to cooperate with second siderail 31 to define a gap 33 therebetween.

A portion 35 of bedframe 27 is moveable between a first position and a second position shown in phantom. First siderail 29 is configured to move with portion 35 of bedframe 27 so that first siderail 29 moves relative to second siderail 31. During or after the initial relative movement of first and second siderails 29, 31, second siderail 31 moves relative to first siderail 29 in direction 37 to compensate for the initial relative movement. This compensatory movement in direction 37 aids in maintaining gap 33 substantially constant.

Figure 3:
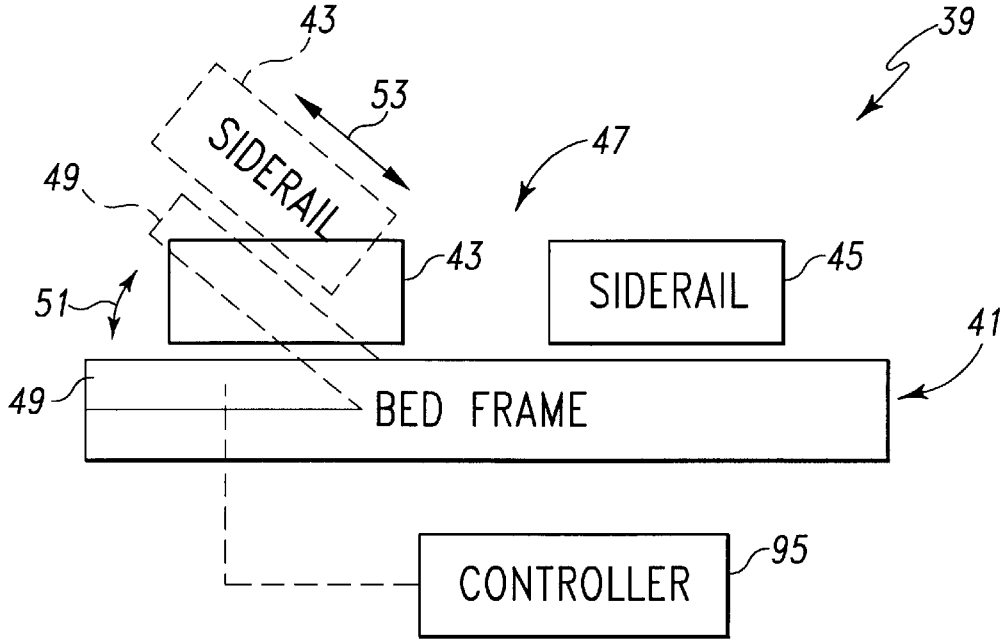
FIG. 3 is a diagrammatic view of another bed showing the bed including a bedframe, first and second siderails, and a controller, a portion of the bedframe rotating between a first position and a second position (in phantom), the first siderail rotating with the portion of the bedframe, and the controller being coupled to the first siderail to coordinate movement of the first siderail relative to the bedframe as the first siderail rotates relative to the bedframe.

A bed 39 according to another embodiment of the present disclosure is shown in FIG. 3. Bed 39 includes a bedframe 41, a first siderail 43 coupled to bedframe 41, a second siderail 45 coupled to bedframe 41, and a controller 95 coupled to first siderail 43. First and second siderails 43, 45 cooperate to define a gap 47 therebetween.

A portion 49 of bedframe 41 is moveable between a first position and a second position shown in phantom. First siderail 43 is configured to move with portion 49 of bedframe 41 in direction 51 so that first siderail 43 moves relative to second siderail 45. Controller 95 accounts for this initial movement of first siderail 43 in direction 51 and coordinates a sliding, pivoting, or other compensating movement of first siderail 43 in direction 53 so that gap 47 remains substantially constant.

Figure 4:
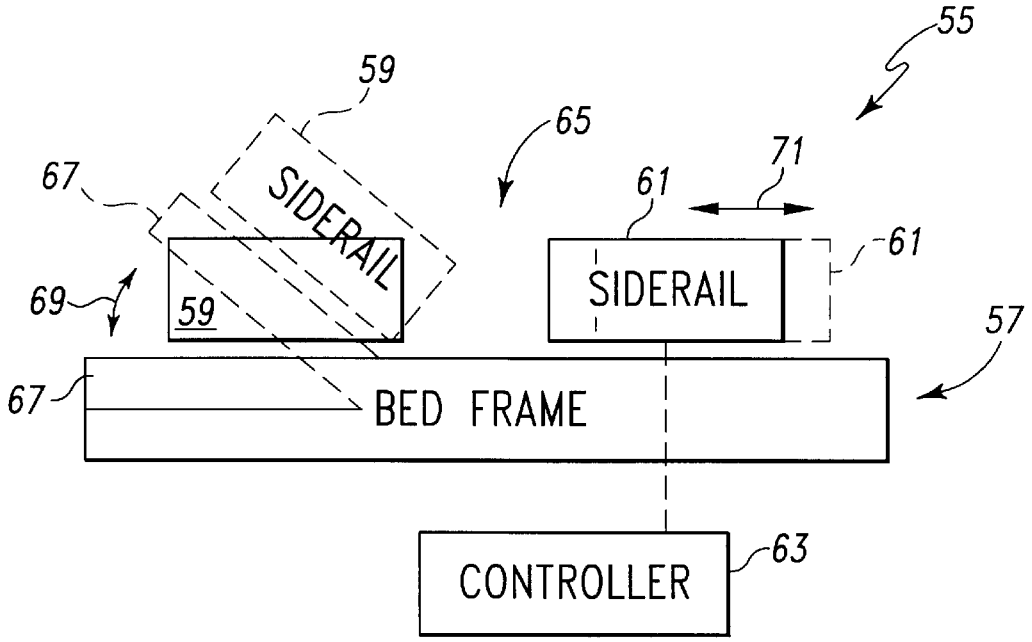
FIG. 4 is a diagrammatic view of another bed showing the bed including a bedframe, first and second siderails, and a controller, a portion of the bedframe rotating between a first position and a second position (in phantom), the first siderail rotating with the portion of the bedframe, and the controller being coupled to the second siderail to coordinate movement of the second siderail relative to the bedframe as the first siderail rotates relative to the bedframe.

A bed 55 according to another embodiment of the present disclosure is shown in FIG. 4. Bed 55 includes a bedframe 57, a first siderail 59 coupled to bedframe 57, a second siderail 61 coupled to bedframe 57, and a controller 63 coupled to second siderail 61. First and second siderails 59, 61 cooperate to define a gap 65 therebetween.

A portion 67 of bedframe 57 is moveable between a first position and a second position shown in phantom. First siderail 59 is configured to move with portion 67 of bedframe 57 in direction 69 so that first siderail 59 moves relative to second siderail 61. Controller 63 accounts for this initial movement of first siderail 59 in direction 69 and coordinates a sliding, pivoting, or other compensating movement of second siderail 61 in direction 71 so that gap 65 remains substantially constant.

According to a preferred embodiments of the present disclosure, the controllers are exclusively mechanical and includes a linkage system for coordinating the relative movement of the siderails. According to alternative embodiments, the controllers include electric components including such devices as motors, controls, processors, sensors, or electric actuators. Furthermore, the controllers may be pneumatic including such devices as pneumatic actuators, controls, sensors, or reservoirs. Other configurations of controllers may also be used.

Figure 5:
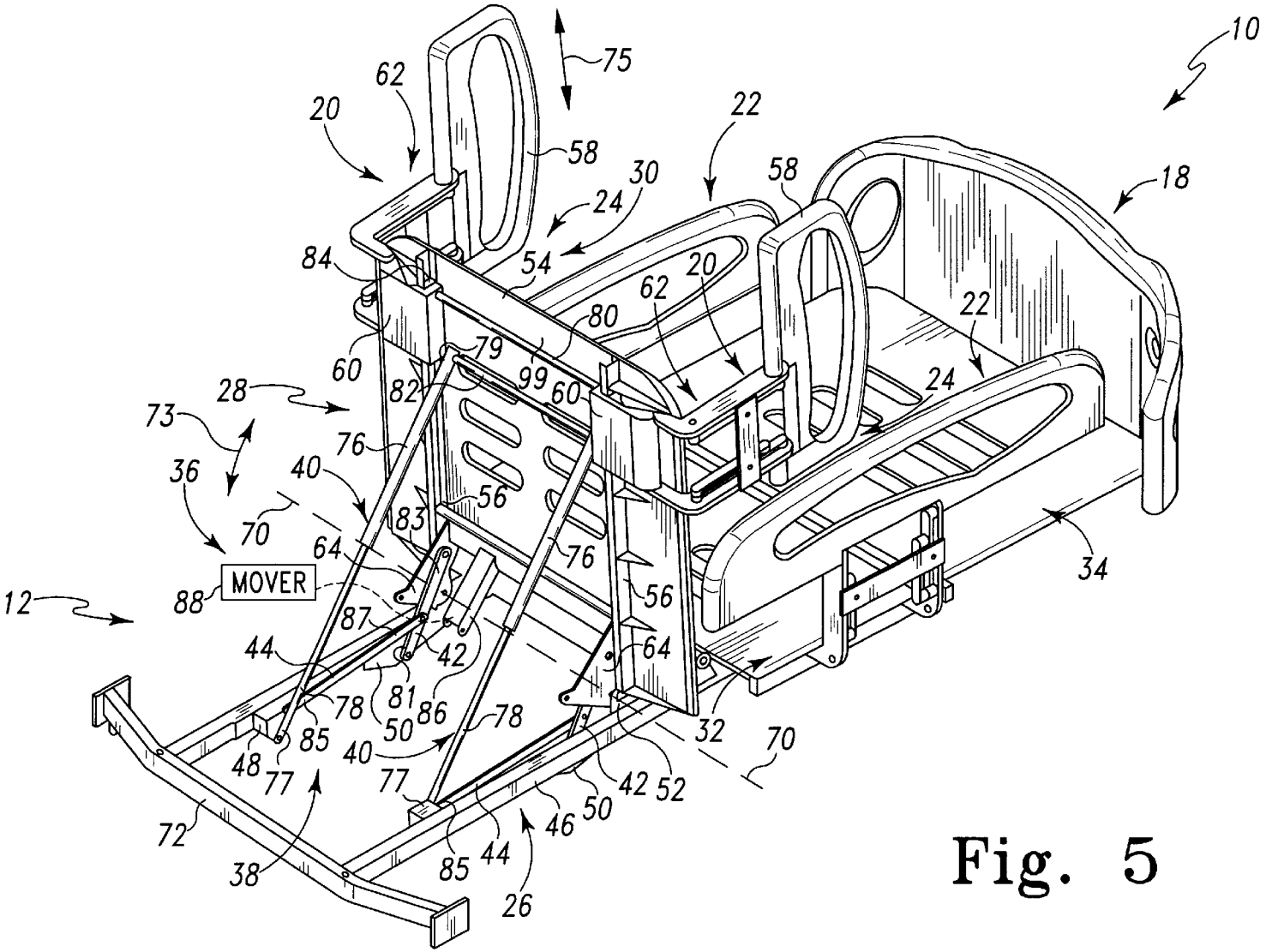
FIG. 5 is a perspective view of a preferred embodiment bed showing a bedframe (with portions removed for clarity) including an intermediate frame and an articulating deck coupled to the intermediate frame, the articulating deck including a head section positioned in a substantially vertical position and thigh and foot sections positioned in substantially horizontal positions, the bed further including a linkage system configured to control movement of head end siderails along the head section of the articulating deck during movement of the head section of the deck relative to the intermediate frame member.
Figure 6:
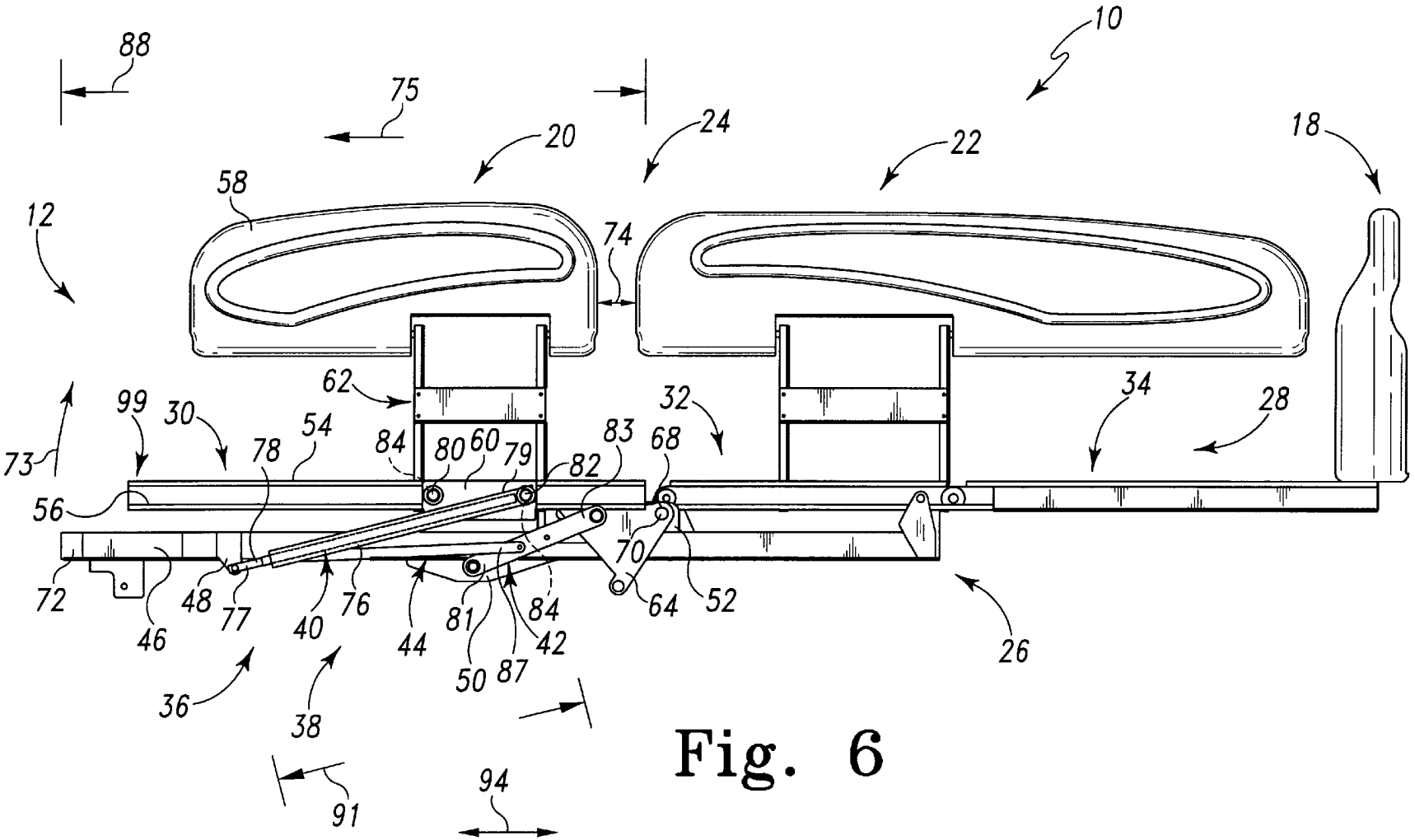
FIG. 6 is a side elevation view of the bed of FIG. 5 showing the head section of the articulating deck in a substantially horizontal position with the head end siderails positioned near a foot end of the head section of the deck.
Figure 7:
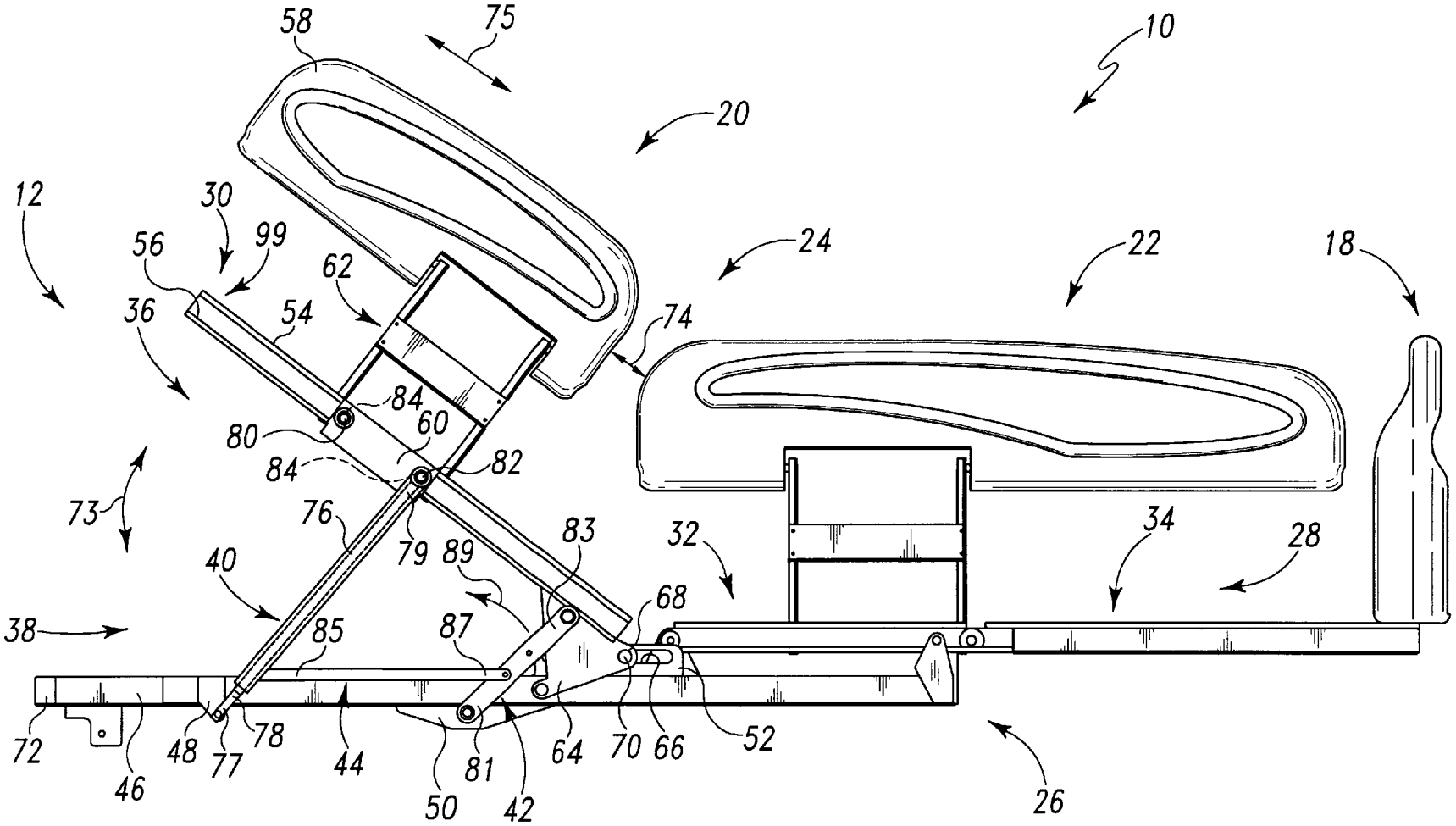
FIG. 7 is a view similar to FIG. 6 showing the head section of the deck in an intermediate position with the head end siderails moved toward the head end of the head section to a position between the head and foot ends of the head section of the deck.
Figure 8:
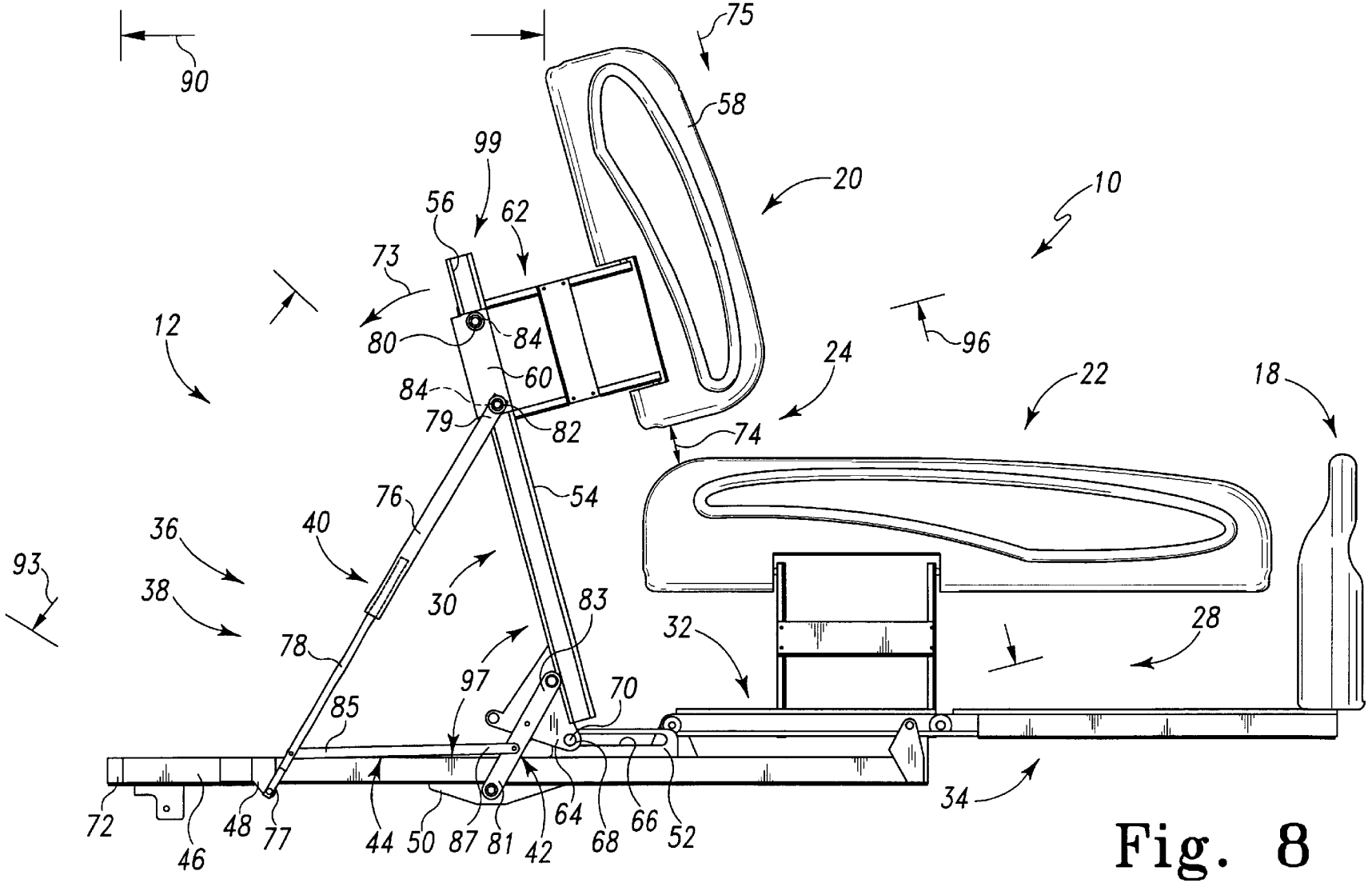
FIG. 8 is a view similar to FIGS. 6 and 7 showing the head section of the deck in the substantially vertical position with the head end siderails moved toward the head end of the head section to a position near the head end of the head section.

A presently preferred bed 10 is shown in FIG. 5. Bed 10 includes a bedframe 12 and several barriers such as a headboard 16, a footboard 18, a pair of head end siderails 20, and a pair of foot end siderails 22. All of these barriers are coupled to bedframe 12. As shown in FIGS. 6–8, siderails 20, 22 cooperate to define a pair of gaps 24 therebetween.

Bedframe 12 is configured to manipulate a mattress (not shown) into several configurations such as a bed position, as shown in FIG. 6, and a seated position as shown in FIG. 7. As bedframe 12 moves between these positions, head end siderails 20 pivot relative to foot end siderails 22 in directions 73. As shown in FIGS. 6–8, gaps 24 between head and foot end siderails 20, 22 remain substantially constant as head end siderails 20 pivot relative to foot end siderails 22. Gaps 24 remain substantially constant because head end siderails 20 slide in a direction 75 to compensate for the pivoting movement in direction 73 as shown in FIG. 7.

Bedframe 12 includes a deck support 26 and a deck 28 coupled to deck support 26 to support the mattress. Deck support 26 is configured to raise and lower deck 28 and to position deck 28 in the Trendelenburg and reverse-Trendelenburg positions. Further description of deck support 26 is provided in U.S. Pat. No. 5,715,548 to Weismiller, et al., the disclosure of which is expressly incorporated by reference herein.

Deck 28 is configured to articulate between several positions. As shown in FIG. 6, deck 28 is positioned in a bed position so that so that deck 28 is substantially flat. Deck 28 is also configured to move to a seated position, as shown in FIG. 8, in which deck 28 has an L-shape permitting a patient to sit upright on bed 10. Deck 28 includes a head section 30, a seat section 32 pivotably coupled to deck support 26, and a foot section 34 pivotably coupled to seat section 32. As shown in FIGS. 6–8, head section 30 is configured to pivot between a first substantially horizontal position and a second substantially vertical position. While in the first position, shown in FIG. 6, head section 30 and deck support cooperate to define a first angle therebetween of about 0° and while in the second position, as shown in FIG. 8, head section 30 and deck support cooperate to define a second angle 97 therebetween of about 75°.

Bed 10 further includes a mover 86 configured to move head sections 30 between the first and second positions. As shown in FIG. 5, head section 30 of deck 28 further includes an mover bracket 86 to which mover 88 is coupled to power the rotation of head section 30. According to the presently preferred embodiment of the present disclosure, mover 88 is a pneumatic actuator. According to alternative embodiments, the mover may be an electric actuator, a motor, or any other device that provides power to articulate the deck.

Head end siderails 20 are coupled to head section 30 of deck 28 so that as head section 30 pivots in direction 73 during articulation of deck 28, head end siderails 20 also pivot in direction 73. To maintain a constant gap between head and foot end siderails 20, 22, the initial pivoting movement of the head end siderails 20 is compensated for by sliding head end siderails 20 relative to head section 30 of deck 28. According to alternative embodiments of the disclosure, other types of movement other than sliding are used to compensate for the initial movement of the siderail.

According to the preferred embodiment of the present disclosure, bed 10 also includes a controller 36 that coordinates the sliding movement of head end siderails 20 relative to head section 30 of deck 28 as head section 30 and head end siderails 20 pivot relative to deck support 26. In the illustrated embodiment, controller 36 includes a linkage system 38 coupled to deck support 26, head end siderails 20, and head section 30 of deck 28. According to alternative embodiments, the controller includes electric components including such devices as motors, controls, processors, sensors, or electric actuators. Furthermore, the controller may be pneumatic including such devices as pneumatic actuators, controls, sensors, or reservoirs. Other configurations of controllers may also be used.

Linkage system 38 includes first, second, and third links 40, 42, 44. Deck support 26 includes an intermediate frame member 46, first downwardly extending flanges 48 coupled to intermediate frame member 46, second downwardly extending flanges 50 coupled to intermediate frame member 46, and upwardly extending flanges 52 coupled to intermediate frame 46. Head section 30 of deck 28 includes a substantially flat panel 54, a pair of channels 56 coupled to panel 54, and downwardly extending triangle-shaped flanges 64 coupled to panel 54 and channels 56 as shown, for example, in FIG. 5.

Head end siderails 20 include a pair of rail members 58, a pair of shuttles 60, and a pair of linkages 62 pivotably coupling rail members 58 to shuttle 60. A suitable set of linkages and rail members is described in U.S. Pat. No. 5,715,548.

First links 40 include first ends 77 pivotably coupled to respective first downwardly extending flanges 48 of deck support 26 and second ends 79 pivotably coupled to respective shuttles 60. Second links 42 include first ends 81 pivotably coupled to respective second downwardly extending flanges 50 of deck support 26 and second ends 83 pivotably coupled to respective triangular flanges 64 of head section 30. Third links 44 include first ends 85 pivotably coupled to respective first links 40 and second ends 87 pivotably coupled to respective second links 42.

As shown in FIG. 8, upwardly extending flanges 52 of deck support 26 are formed to include slots 66. Head section 30 of deck 28 includes pins 68 coupled to respective flanges 64 and positioned in respective slots 66 that permit head section 30 to rotate about an axis of rotation 70 during movement of head section 30 between the horizontal and substantially vertical positions. As head section 30 rotates, second links 42 force pins 68 to slide in slots 66 so that axis of rotation 70 moves closer to a head end 72 of deck support 26. Thus, head section 30 is both pivotably and slidably coupled to deck support 26.

As head section 30 rotates from the flat position to the substantially vertical position in direction 73, second links 42 rotate in a counterclockwise direction 89 as shown in FIGS. 6–8. Third links 44 transmit this counterclockwise rotation from respective second links 42 to respective first links 40, as shown in FIGS. 6–8, so that first and second links 40, 42 remain substantially parallel as head section 30 rotates from the flat position to the substantially vertical position. Thus, third links 44 fix the angular position of first links 40 to the angular position of second links 42. As second links 42 rotate due to the rotation of head section 30, first links 40 follow the same rotation.

As first links 40 rotate, they push shuttles 60 along channels 56 of head section 30 so that rail members 58 slide near a head end 83 of head section 30. This coordinated movement of head end siderail 20 relative to head section 30 maintains gap 24 at a substantially constant width as head end siderails 20 pivot in direction 73. Thus, as head section 30 rotates about axis of rotation 70, head end siderails 20 remain spaced apart from foot end siderails 22 by a substantially constant distance 74 as shown in FIGS. 6–8.

First links 40 have a variable length so that as head section 30 rotates, the overall lengths of first links 40 change. First links 40 are telescopic and include first link members 76 pivotably coupled to respective shuttles 60 and second link members 78 pivotably coupled to respective downwardly extending flanges 48 and slidably received in respective first links 76. During rotation of first links 40, second link members 78 slide relative to first link members 76 so that the overall length of first links 40 change. For example, as shown in FIG. 6, first link 40 has a first length 91 and, as shown in FIG. 8, first link 40 has a second length 93 that is greater than first length 91.

The movement of shuttles 60 is coordinated by a pair of rods 80, 82 extending between shuttles 60. Each first link member 76 of first links 40 is pivotably coupled to respective ends of rod 80 as shown in FIG. 5. Each rod 80, 82 includes a pair of rollers 84 coupled to the respective ends and positioned in channels 56 so that shuttles 60 slide smoothly along channels 56.

In operation, as head section 30 rotates about axis of rotation 70, head end siderails 20 also rotate about axis of rotation 70, as shown in FIGS. 6–8. During this rotation, axis of rotation 70 moves from a first location at a first distance 88 from head end 72 of deck support 26 to a second location at a second distance 90 from head end 72 that is less than first distance 88. Thus, according to the presently preferred embodiment, head section 30 both pivots and slides relative to deck support 26. Also during the rotation, shuttles 60 move from a first location at a first distance 94 from axis of rotation 70 to a second location at a second distance 96 from axis of rotation 70 that is greater than the first distance 94.

Although the invention has been described in detail with reference to certain illustrated embodiments, variations exist within the scope and spirit of the invention as described and as defined in the following claims.

What is claimed is:

1. A bed comprising a bedframe, a mattress positioned on the bedframe, a first siderail coupled to the bedframe, and a second siderail movable relative to the first siderail, the second siderail being coupled to the bedframe to slide relative to the bedframe during relative movement of the first and second siderails.

2. The bed of claim 1, wherein the bedframe includes a deck support and a deck positioned on the deck support, the deck includes a first section and a second section movable relative to the first section, and the second siderail is slidably coupled to the second section of the deck.

3. The bed of claim 1, wherein the bedframe includes a deck support and a deck positioned on the deck support, the deck includes a first section and a second section movable relative to the first section, and the second section of the deck is slidably coupled to the deck support.

4. The bed of claim 3, wherein the second section of the deck is pivotably coupled to the deck support.

5. The bed of claim 3, wherein the deck support includes a slot and the second section of the deck includes a pin positioned to slide in the slot.

6. The bed of claim 1, further comprising a first link wherein the bedframe includes a deck support and a deck positioned on the deck support, the deck includes a first section and a second section movable relative to the first section, and the first link is pivotably coupled to the second siderail and pivotably coupled to the deck support to coordinate sliding movement of the second siderail with movement of the second section of the deck relative to the first section of the deck.

7. The bed of claim 6, wherein the first link is telescopic.

8. The bed of claim 6, further comprising second and third links, wherein the second link is pivotably coupled to the second section of the deck and pivotably coupled to the deck support, and the third link is pivotably coupled to the first link and pivotably coupled to the second link.

9. The bed of claim 8, wherein the second section of the deck is slidably coupled to the deck support.

10. The bed of claim 1, wherein the bedframe includes a deck support and a deck positioned on the deck support, the deck includes a first section and a second section movable relative to the first section, and the second siderail includes a shuttle slidably coupled to the second section of the deck and a rail member pivotably coupled to the shuttle.

11. The bed of claim 10, wherein the second section of the deck includes a channel sized to slidably receive the shuttle.

12. A bed comprising a bedframe including a deck support and a deck, the deck being configured to articulate, a first siderail coupled to the bedframe, a second siderail coupled to the deck, the second siderail being spaced apart from the first siderail by a distance to define a gap therebetween, and means for moving at least one of the first siderail relative to the bedframe and the second siderail relative to the deck to maintain the distance between the first and second siderails due to the articulation of the deck.

13. The bed of claim 12, wherein the moving means includes a first link pivotably coupled to the second siderail and pivotably coupled to the deck support.

14. The bed of claim 13, wherein the first link includes first and second link members, the first link member is pivotably coupled to the second siderail, the second link member is pivotably coupled to the deck support, and the second link member is slidably coupled to the first link member.

15. The bed of claim 13, wherein the deck includes a first section and a second section configured to move relative to the first section during articulation of the deck, the moving means further includes second and third links, the second link is pivotably coupled to the second section of the deck and pivotably coupled to the deck support, and the third link is pivotably coupled to the first link and pivotably coupled to the second link.

16. The bed of claim 12, wherein the deck includes a first section and a second section configured to move relative to the first section during articulation of the deck, and the second section of the deck is slidably coupled to the deck support.

17. The bed of claim 12, wherein the deck includes a first section and a second section configured to move relative to the first section during articulation of the deck, and the second siderail is slidably coupled to the second section of the deck.

18. The bed of claim 17, wherein the second siderail includes a shuttle slidably coupled to the second section of the deck and a rail member pivotably coupled to the shuttle.

19. The bed of claim 18, wherein the second section of the deck includes a channel configured to slidably receive the shuttle of the second siderail.

20. The bed of claim 12, wherein the first siderail is slidably coupled to the bedframe.

21. The bed of claim 12, wherein the first siderail includes a shuttle slidably coupled to the deck support and a rail member pivotably coupled to the shuttle.

22. The bed of claim 21, wherein the deck support includes a channel and the shuttle is positioned to slide on the channel.

23. The bed of claim 12, wherein the deck includes a first section and a second section configured to move relative to the first section during articulation, and the moving means permits the second siderail to move from a foot end of the second section of the deck to a head end of the second section of the deck.

24. A bed comprising a bedframe including a deck support and a deck coupled to the deck support, the deck including a first section and a second section configured to move between first and second positions relative to the deck support, a first siderail coupled to the bedframe, and a second siderail coupled to the second section of the deck, the second siderail being configured to move relative to the second section of the deck to compensate for movement of the second section of the deck relative to the first section of the deck.

25. The bed of claim 24, wherein the second section of the deck includes a first end and a second end spaced apart from the first end, the second siderail is coupled near the first end of the second section of the deck when the second section is in the first position, and the second siderail is coupled near the second end of the second section of the deck when the second section is in the second position.

26. The bed of claim 25, wherein the bedframe further includes a link coupled to the second siderail and coupled to the deck support to control movement of the second siderail relative to the second section of the deck as the second section of the deck moves between the first and second positions.

27. The bed of claim 26, wherein the link has a variable length.

28. The bed of claim 24, wherein the second section of the deck is coupled to the deck support at first location when in the first position and the second section of the deck is coupled to the deck support at a second location when in the second position.

29. The bed of claim 28, wherein the deck support includes a first end and a second end, the first location is spaced apart from the first end of the deck support by a first distance, and the second location is spaced apart from the first end of the deck support by a second distance that is less than the first distance.

30. The bed of claim 29, wherein the deck support and the second section of the deck cooperate to define a first angle therebetween when the second section is in the first position and a second angle therebetween when the second section is in the second position that is greater than the first angle.

31. A bed comprising a bedframe including a deck support and a deck coupled to the deck support, the deck including a first section and a second section configured to move between first and second positions relative to the deck support, a first siderail coupled to the second section of the deck to move therewith between the first and second positions, and a second siderail coupled to the bedframe, the second siderail being configured to move relative to the bedframe to compensate for movement of the first siderail between the first and second positions with the second section of the deck.

32. The bed of claim 31, wherein the second siderail includes a first end and a second end, the bedframe includes a first end and a second end, the first end of the second siderail is spaced apart from the first end of the bedframe by a first distance when the second section of the deck is in the first position, and the first end of the second siderail is spaced apart from the first end of the bedframe by a second distance when the second section of the deck is in the second position, the second distance being greater than the first distance.

33. The bed of claim 31, wherein the second siderail is coupled to the second section of the deck through a linkage system.

34. A bed comprising a bedframe including a deck support and a deck coupled to the deck support, the deck including a first section and a second section configured to move between first and second positions relative to the deck support, a first siderail coupled to the second section of the deck to move therewith between the first and second positions, and a second siderail coupled to the bedframe, the second siderail being configured to move relative to the bedframe to compensate for movement of the first siderail between the first and second positions, the movement of the second siderail relative to the bedframe being linear.

35. The bed of claim 34, wherein the second siderail slides relative to the bedframe.

36. The bed of claim 34, wherein the first and second siderails cooperate to define a gap therebetween and movement of the second siderail relative to the bedframe maintains the gap at a constant length during movement of the first siderail with the deck section.

37. A bed comprising a bedframe including first and second components, the first and second components being configured to move relative to one another, a first siderail coupled to the first component of the bedframe to move therewith.

a second siderail coupled to the second component of the bedframe, and a controller coupled to at least one of the first and second siderails to control relative movement of the first and second siderails to compensate for the relative movement of the first and second components of the bedframe.

38. The bed of claim 37, wherein the controller includes a link coordinating movement of the second siderail with the relative movement of the first and second components.

39. The bed of claim 38, wherein the link is pivotably coupled to the second siderail and pivotably coupled to the bedframe.

40. The bed of claim 38, wherein the link is pivotably coupled to the second siderail and to the first component of the bedframe.

41. The bed of claim 37, wherein in the controller slides the second siderail relative to the second component of the bedframe during relative movement of the first and second components of the bedframe.

42. The bed of claim 37, wherein the controller is mechanical.

43. The bed of claim 37, wherein the second component of the bedframe is a deck section configured to support a mattress.

44. The bed of claim 37, wherein the bedframe includes a deck positioned to support a mattress and the second component of the bedframe is a frame member configured to support the deck thereon.

45. The bed of claim 37, wherein the controller is configured to slide the second component relative to the first component.

46. The bed of claim 45, wherein the relative movement between the first and second components of the bedframe is pivotable.

47. A bed comprising a bedframe including a deck support and a deck coupled to the deck support, a mover configured to move the deck relative to the deck support, a first siderail coupled to the bedframe, a second siderail coupled to deck to move with the deck during movement of the deck by the mover, the first siderail being spaced apart from the second siderail by a distance to define a gap therebetween, and means for moving at least one of the first and second siderails to maintain the distance between the first and second siderails to compensate for the movement of the second siderail with the deck.

48. The bed of claim 47, wherein the moving means includes a first link pivotably coupled to the second siderail and pivotably coupled to the deck support.

49. The bed of claim 47, wherein the first link includes first and second link members, the first link member is pivotably coupled to the second siderail, the second link member is pivotably coupled to the deck support, and the second link member is slidably coupled to the first link member.

50. The bed of claim 48, wherein the deck includes a first section and a second section configured to move relative to the first section during articulation of the deck, the moving means further includes second and third links, the second link is pivotably coupled to the second section of the deck and pivotably coupled to the deck support, and the third link is pivotably coupled to the first link and pivotably coupled to the second link.

51. The bed of claim 47, wherein the deck includes a first section and a second section configured to move relative to the first section during movement of the deck and the second section of the deck is slidably coupled to the deck support.

52. The bed of claim 47, wherein the deck includes a first section and a second section configured to move relative to the first section during movement of the deck and the second siderail is slidably coupled to the second section of the deck.

53. The bed of claim 52, wherein the second siderail includes a shuttle slidably coupled to the second section of the deck and a rail member pivotably coupled to the shuttle.

54. The bed of claim 53, wherein the second section of the deck includes a channel configured to slidably receive the shuttle of the second siderail.

55. The bed of claim 47, wherein the first siderail is slidably coupled to the deck support.

56. The bed of claim 47, wherein the second siderail includes a shuttle slidably coupled to the deck support and a rail member pivotably coupled to the shuttle.

57. The bed of claim 56, wherein the deck support includes a channel and the shuttle is positioned to slide on the channel.

58. The bed of claim 47, wherein the deck includes a first section and a second section configured to move relative to the first section during movement of the deck, and the moving means permits the second siderail to move from a foot end of the second section of the deck to a head end of the second section of the deck.

59. A bed comprising a bedframe including a deck support and a deck, the deck having a deck section configured to rotate about an axis of rotation between first and second positions, and a siderail configured to rotate about the axis of rotation between first and second positions with the deck section, the siderail being positioned from the axis of rotation by a first distance when in the first position, the siderail being positioned from the axis of rotation by a second distance when in the second position, the second distance being greater than the first.

60. The bed of claim 59, further comprising a controller coupled to the siderail to coordinate movement of the siderail relative to the axis of rotation with rotation of the siderail.

61. The bed of claim 60, wherein the control includes a link coupled to the siderail and the bedframe.

62. The bed of claim 61, wherein the link has a variable length.

63. The bed of claim 59, wherein the siderail is slidably coupled to the bedframe.

64. A bed comprising a bedframe including a deck support and a deck, the deck including a first deck section and a second deck section pivotably coupled to the deck support, and a siderail configured to rotate about an axis of rotation between first and second positions, the siderail being coupled to the second section of the deck, the siderail being positioned from the axis of rotation by a first distance when in the first position, the siderail being positioned from the axis of rotation by a second distance when in the second position, the second distance being greater than the first.

65. The bed of claim 64, wherein the second section of the deck is slidably coupled to the deck support.

66. A bed comprising a bedframe include a deck support and a deck, the deck including a deck section configured to move about an axis of rotation between first and second positions, and a siderail configured to automatically move from a first position at a first distance from the axis of rotation to a second position at a second distance from the axis of rotation when the deck section moves from the first position to the second position, the second distance being greater than the first distance.

67. The bed of claim 66, wherein the siderail is moveable between a raised position blocking egress of a patient and a lowered position, the siderail is in the raised position when moving between the first and second positions.

68. The bed of claim 66, wherein the siderail is coupled to the deck section to move therewith.

69. The bed of claim 66, wherein the siderail is spaced apart from the deck section.

70. The bed of claim 66, wherein siderail slides between the first and second positions.

71. The bed of claim 66, wherein movement of the siderail is linear.

72. The bed of claim 66, further comprising a second siderail, wherein one of the first mentioned and second siderails is coupled to the deck section to move therewith, the first mentioned and the second siderails cooperate to define a gap therebetween, and movement of the first mentioned siderail compensates for movement of the siderail coupled to the deck section.

73. The bed of claim 72, wherein the first mentioned siderail is coupled to the deck section.

74. The bed of claim 72, wherein the second siderail is coupled to the deck section.

* * * * *